United States Patent [19]

Laimer

[11] 4,286,776

[45] Sep. 1, 1981

[54] ARRANGEMENT OF A STEEL-MAKING PLANT FOR CAPTURING AND CONDUCTING AWAY FLUE GASES

[75] Inventor: Friedrich Laimer, Perg, Austria

[73] Assignee: Voest-Alpine Aktiengesellschaft, Linz, Austria

[21] Appl. No.: 38,534

[22] Filed: May 14, 1979

[30] Foreign Application Priority Data

May 30, 1978 [AT] Austria ..... 3916/78

[51] Int. Cl.³ ..... C21C 5/38

[52] U.S. Cl. ..... 266/158; 98/115 UM; 266/144; 266/216; 266/236; 414/191; 414/291

[58] Field of Search ..... 266/158, 159, 144, 216, 266/236; 164/256; 414/185, 191, 291; 98/115 R, 115 UM

[56] References Cited

U.S. PATENT DOCUMENTS

| | | | |
|---|---|---|---|
| 3,529,733 | 9/1970 | Walzel | 414/191 |
| 4,143,864 | 3/1979 | Laimer | 266/158 |

FOREIGN PATENT DOCUMENTS

| | | |
|---|---|---|
| 2030329 | 12/1970 | Fed. Rep. of Germany . |
| 2059205 | 8/1975 | Fed. Rep. of Germany . |
| 2256269 | 5/1977 | Fed. Rep. of Germany . |

*Primary Examiner*—Michael L. Lewis

*Attorney, Agent, or Firm*—Brumbaugh, Graves, Donohue & Raymond

[57] ABSTRACT

In an arrangement for capturing and conducting away flue gases forming during charging of, and pouring off from, metallurgical vessels in a steel-making plant, the material to be charged and poured off is brought into and out of the operating position by a container displaceable by means of a crane. The crane trolley is designed to form a displaceable unit with a hood having a draft opening. The hood, in the operating position, covers the container and the mouth of the metallurgical vessel, and the draft opening borders on the discharge opening of a chimney so as to form a flow connection therewith.

7 Claims, 7 Drawing Figures

ARRANGEMENT OF A STEEL-MAKING PLANT FOR CAPTURING AND CONDUCTING AWAY FLUE GASES

BACKGROUND OF THE INVENTION

The present invention relates to an arangement for capturing and conducting away flue gases forming during charging of, and pouring off from, metallurgical vessels in a steel-making plant, wherein the material to be charged and poured off, respectively, is brought into, and out of, the operating position by a container that is displaceable by means of a crane.

When producing steel, intensive smoke will develop at various places in the steel-making plant, e.g. when pouring pig iron from a torpedo mixer into ladles, when loading pig iron into the pig iron mixer, and when loading ladles from the pig iron mixer. Furthermore, a strong development of smoke is caused during the processes of charging scrap and pig iron into the converter. During these charging, pouring and pouring-off processes the containers containing the molten-liquid material are hanging from a crane by means of a crane suspension, and it is difficult to provide immediately effective exhaust arrangements at the various places where the development of smoke occurs.

The dedusting problems arising during charging and tapping of metallurgical vessels, in particular a pig iron mixer or an electric furnace, have not been satisfactorily solved. With the roof-suction method frequently applied in recent times, suction arrangements are arranged at the highest spots in the roof of the hall of the steel-making plant above the aggregates that develop the smoke. Through these suction arrangements, not only the smoke, but also the air of the hall are removed, and the filtering arrangement is additionally strained. Since the distance between a smoke-developing aggregate and the suction arrangements in the roof of the hall is very large, the danger exists that only a weak force will be exerted to cause the smoke and dust particles to ascend, thus these particles will not be seized by the suction stream and will settle back down to the plant floor again. Therefor, the induced draft installations have to be designed so as to be highly efficient, which results in high investment costs.

When using hoods which are arranged directly above a smoke-developing aggregate, the difficulty exists that these can be designed only up to a certain size, due to the fact that it is necessary for the crane to move close to the metallurgical vessel, e.g. a converter, during charging. Thus they are too small for completely capturing the emerging smoke and part of the flue gases escape past the hood.

SUMMARY OF THE INVENTION

The invention aims at avoiding these disadvantages and difficulties and has as its object to provide an arrangement with which the gases forming during the production of steel will be seized almost totally. It is a further object of the invention to provide an arrangement that advantageously can be utilized for a plurality of working stands where smoke develops and to permit the hall crane to be displaceable from stationary installations into the various operating positions without being impeded.

With an arrangement of the initially-defined kind, these objects are achieved according to the invention in that the crane trolley forms a displaceable unit with a hood, which hood, in the operating position, covers the container and the mouth of the metallurgical vessel and borders on a chimney.

According to a preferred embodiment, the crane trolley and hood unit is displaceable at least between two operating positions, e.g. between the loading position and the pouring-off position of a metallurgical vessel, such as a pig iron mixer, and the hood is connectable to a chimney in any of the operating positions.

The opening in the discharge chimney is advantageously widened and preferably elongated in the moving direction of the crane trolley, so that correctional movements of the crane trolley are feasible without affecting the gas flue. For this reason, it is also suitable that a flange elongated in the running direction of the crane trolley be fastened to the connecting opening of the hood. With this construction, the suction of false air during correctional movements will be avoided.

BRIEF DESCRIPTION OF THE DRAWINGS

The invention will now be explained in more detail with reference to the accompanying drawings, wherein.

DESCRIPTION OF ILLUSTRATIVE EMBODIMENTS

Figure 6A:
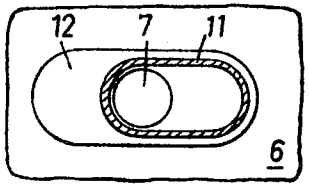
FIGS. 6 and 6*a* show sections along line VI—VI of FIG. 5 with FIG. 6 corresponding to the full-line position of FIG. 5 and FIG. 6*a* corresponding to the broken-line position of FIG. 5.
Figure 6:
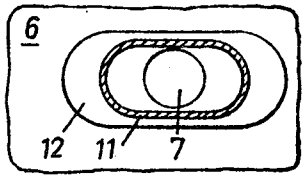
Figure 5:
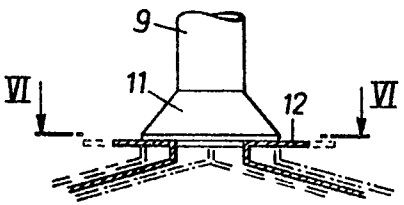
FIG. 5 is a side view of the connecting position of the hood at a chimney opening.

A bridge crane 2 mounted on supports 1 is displaceable on rails 3 along a hall of a steel-making plant. On the crane bridge carriers 4,4'*a* crane trolley 5 is guided, which, according to the invention, forms a displaceable unit with a hood 6 surrounding it. The hood is provided with one or more draft openings 7. In the roof 8 of the hall, discharge chimney sockets 9 are fastened at predetermined places, i.e. above the smoke-developing working stands, which chimney sockets, if desired, lead via collecting conduits 10 to a common suction and filtering plant. The discharge chimney sockets possess a funnel-shaped, enlarged part 11. The connecting part of the hood 6 is designed with a flange 12 that is elongated in the running direction of the crane trolley, as can more clearly be seen from FIGS. 5, 6 and 6*a*. After moving of the hood into the operating position, correctional movements in the longitudinal direction of displacement are possible during which the seal is maintained due to the longitudinal construction of the flange 12. FIG. 6 corresponds to the full-line position of FIG. 5, in which a correction may be carried out in both directions, forwards and backwards. FIG. 6*a* corresponds to the broken-line position of FIG. 5. The openings of the discharge chimney sockets can be opened and closed by screens, flaps and the like, wherein end switches, wing controls or similar devices may be provided for actuating the same.

Figure 4:
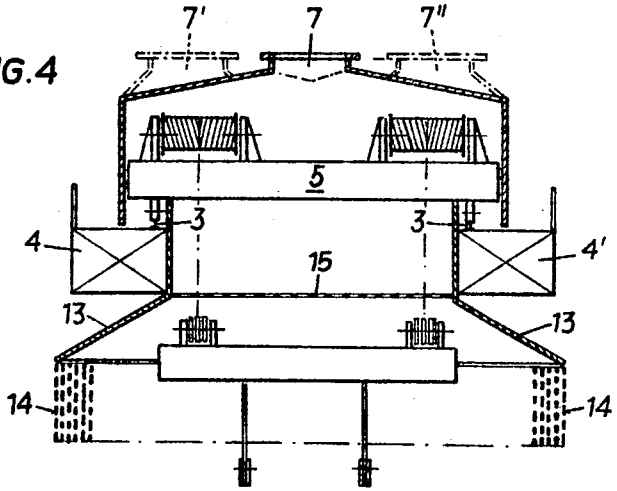
FIG. 4 is a partially-sectioned front view of the arrangement.

In the operating position, the opening of a discharge chimney socket 9, which forms a flow connection with the draft opening 7 of hood 6, is opened, while all the other chimney sockets advantageously remain closed in order to avoid false air from being sucked into the filtering plant. The hood, as is illustrated in FIGS. 1 to 4, can be equipped with guide plates 13 laterally attached to its lower edge, and a chain curtain 14, in order to ensure a better guidance of the smoke. The guide plates are guided downwards, between the bridge carriers 4, 4' (FIG. 4). Furthermore, a mesh grid 15 can be provided at the lower side, in order to prevent flames from passing through.

Figure 1:
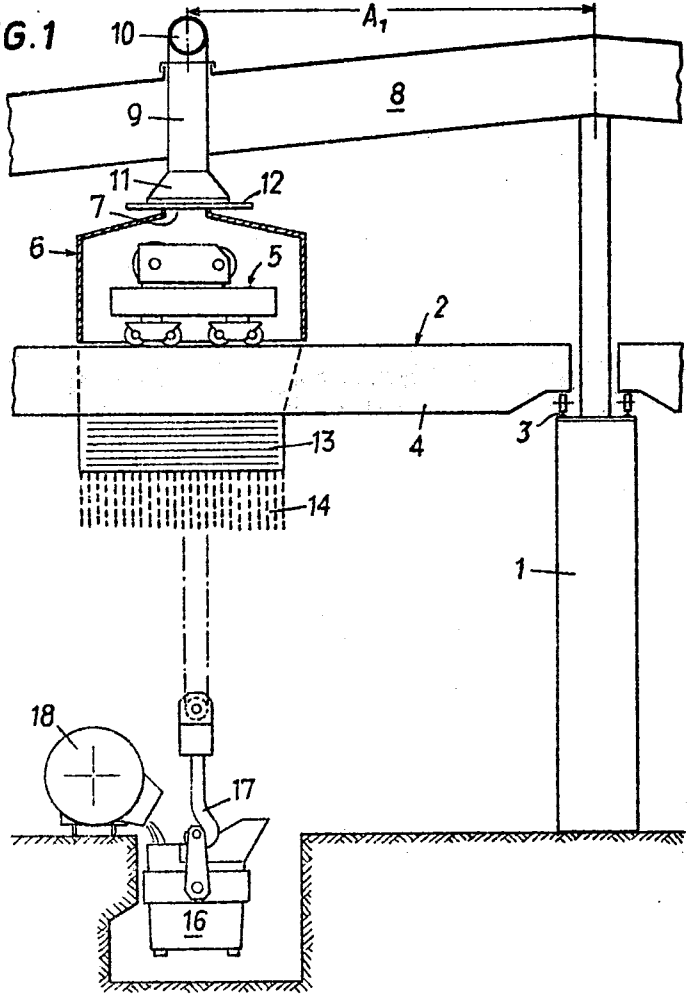
FIG. 1 is a partially-sectioned side view of the arrangement at a pig iron pouring pit.

In each of FIGS., 1–3 a different possibility of utilizing the arrangement according to the invention is illustrated, e.g. in FIG. 1 at a pig iron pouring pit. In this case, a pig iron transporting ladle 16 is hanging on a hook 17 of the crane trolley 5 and is loaded from a torpedo mixer 18. The smoke rising during the loading process is taken up by the hood 6 and led off through the discharge chimney socket 9, which is arranged at a distance $A_1$ from the crane support 1.

Figure 2:
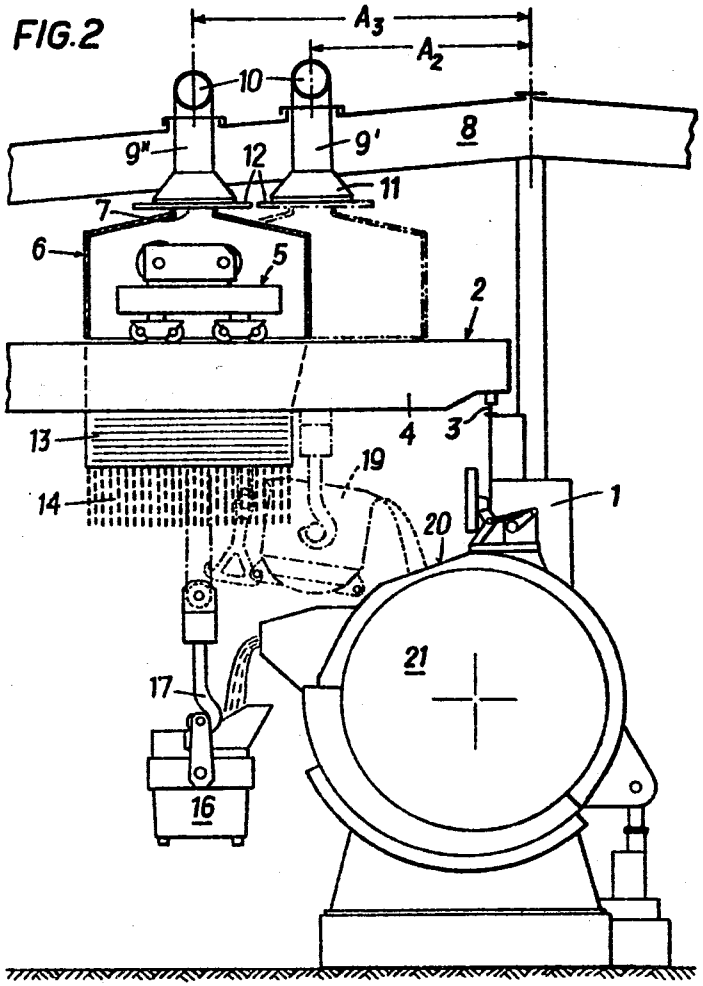
FIG. 2 is a partially-sectioned side view of the arrangement at a pig iron mixer in two positions.

FIG. 2 illustrates the utilization of an arrangement of the invention when pouring pig iron into a pig iron mixer 21, and when pouring pig iron out of the mixer into a transporting ladle 16. In the pouring-in position, the unit which, according to the invention, includes the crane trolley 5 and the hood 6, has been moved into the operating position marked with a dot-and-dash line. Also, it can be clearly seen from the drawings that the crane trolley is only displaceable with, and while within, said hood. In this position the lip of a pig iron ladle 19 comes to rest below the pouring-in opening 20 of the pig iron mixer 21, so that the loading process can start by tilting the ladle 19. The pertaining chimney socket 9', to which the hood is connected, is at a distance $A_2$ from the crane support. When loading the transporting ladle 16, the hood 6 is moved into the position drawn in full lines and connects with the pertaining discharge chimney socket 9'' which is at a distance $A_3$ from the crane support 1.

Figure 3:
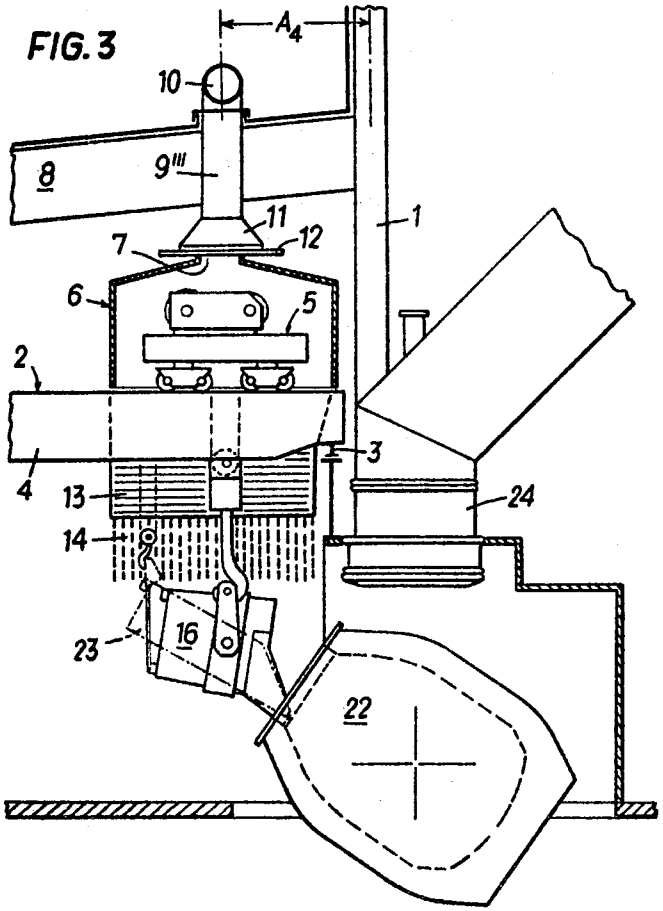
FIG. 3 is a side view of the arrangement at a converter stand.

In FIG. 3, charging of a converter 22 by means of a scrap chute 23 or a pig iron transporting ladle 16 is illustrated, the converter being in a tilted position. The hood 6, which has been placed in position above the mouth of the converter 22 and the charging containers 16, 23, will then border on the discharge chimney socket 9''', which in turn is at a distance $A_4$ from a crane support 1. Centrally above the converter stand a principal hood 24 is provided which receives the flue gases forming during refining, when the converter 22 is in the upright position.

What I claim is:

1. In an arrangement of a steel-making plant for capturing and conducting away flue gases emerging during charging and pouring off, of the type including a metallurgical vessel having a vessel mouth, a container for accommodating material to be charged and poured off, and a crane for displacing said container into and out of an operating position, the improvement which comprises a discharge chimney having an opening, a crane trolley, and a hood with a draft opening, said crane trolley being disposed completely within said hood and being attached thereto so as to form a unit with said hood such that said crane trolley is only displaceable with, and while within, said hood, said hood, in the operating position, covering said container and said vessel mouth, and the draft opening of said hood bordering on said opening of said chimney so as to form a flow connection therewith.

2. An arrangement as set forth in claim 1, wherein said displaceable unit is displaceable between at least two operating positions of said metallurgical vessel, each operating position having a discharge chimney, said hood being in flow connection with the associated chimney when in each of said at least two operating positions.

3. An arrangement as set forth in claim 2, wherein said displaceable unit is displaceable between a filling-in position and a pouring-off position.

4. An arrangement as set forth in claim 1, wherein said metallurgical vessel is a pig iron mixer.

5. An arrangement as set forth in claim 1, wherein the opening in said discharge chimney is enlarged so as to allow for correctional movements of said crane trolley without impeding the flue gases from being conducted away through said flow connection.

6. An arrangement as set forth in claim 5, wherein the opening in said discharge chimney is enlarged and elongated in the running direction of said crane trolley.

7. An arrangement as set forth in claim 1, wherein a flange is fastened at said draft opening of said hood, said flange being elongated in the running direction of said crane trolley.

* * * * *